US006193478B1

(12) United States Patent
Lin et al.

(10) Patent No.: US 6,193,478 B1
(45) Date of Patent: Feb. 27, 2001

(54) CONSTRUCTION OF A FAN

(75) Inventors: Kuo-Cheng Lin; Yung-Hua Liu, both of Taoyan (TW)

(73) Assignee: Delta Electronics, Inc., Taoyuan-Shien (TW)

( * ) Notice: Subject to any disclaimer, the term of this patent is extended or adjusted under 35 U.S.C. 154(b) by 0 days.

(21) Appl. No.: 09/259,686

(22) Filed: Mar. 1, 1999

(30) Foreign Application Priority Data

Sep. 23, 1998 (TW) ..... 87215853

(51) Int. Cl.[7] ..... F04B 17/00; F01D 25/26

(52) U.S. Cl. ..... 417/423.15; 417/360; 417/423.14; 415/213.1

(58) Field of Search ..... 417/423.15, 423.14, 417/360; 415/208.1, 211.1, 213.1, 214.1, 220, 223

(56) References Cited

U.S. PATENT DOCUMENTS

| | | | | |
|---|---|---|---|---|
| 4,120,615 | * | 10/1978 | Keem et al. | 417/360 |
| 4,152,094 | * | 5/1979 | Honda et al. | 415/119 |
| 4,189,281 | * | 2/1980 | Katagiri et al. | 415/213 C |
| 4,352,635 | * | 10/1982 | Saunders | 417/362 |
| 4,568,243 | * | 2/1986 | Schubert et al. | 415/213 C |
| 4,711,135 | * | 12/1987 | Horiuchi et al. | 74/473 R |
| 4,807,718 | * | 2/1989 | Lotz | 181/202 |

FOREIGN PATENT DOCUMENTS

3236353 * 4/1984 (DE) .

* cited by examiner

*Primary Examiner*—Timothy S. Thorpe
*Assistant Examiner*—Michael K. Gray

(57) ABSTRACT

An improved construction of a fan fixed to a system housing when in use, including: an impeller which rotates and cuts the surrounding fluid enabling the surrounding fluid to form an axial flow, and which extends over a length in the axial direction of the fan; a driving device having a stator and a rotor adapted to drive the impeller to rotate; and a casing including a mounting seat fastened to the system housing for mounting the stator onto the system housing, and a frame adapted to cover outside the outer circumference of the impeller. The main feature of this fan resides in that the frame of the casing covers only part of the length in the axial direction outside the outer circumference of the impeller. Besides, another feature of this fan is that mounting seat is formed by vibration absorptive material at least at one of the portion where the mounting seat is fastened to the system housing and the portion where the mounting seat is fastened to the frame. Moreover, this fan includes at least a washer sandwiched between the system housing and the mounting seat so as to isolate the system housing from the mounting seat, thereby preventing the vibration produced by the fan from being transmitted directly to the system housing. A gap is formed between the mounting seat and the frame to further enable side air flow.

3 Claims, 4 Drawing Sheets

CONSTRUCTION OF A FAN

FIELD OF THE INVENTION

This invention relates to an improved construction of a fan, having an increased air flow rate and reduced vibration.

DESCRIPTION OF RELATED ARTS

FIG. 1A is a front view of a prior art fan in an assembled state. FIG. 1B is a sectional side view of the same fan. The arrows shown in FIG. 1B represent the flow field produced by the fan. As shown in FIG. 1A and FIG. 1B, the fan comprises an impeller 2, which rotates and cuts the surrounding fluid enabling the surrounding fluid to form an axial flow; a motor 1 having a stator (not shown) and a rotor (not shown) for driving the impeller 2 to rotate; a casing 9 for mounting motor 1 and covering the outer circumference of impeller 2, including a motor mounting seat 4 for fixing motor 1 and a frame 3 for covering the outer circumference of the impeller 2. The whole casing 9 is directly fixed to a system housing 6 when in use.

Basically, a fan is utilized to promote air circulation resulting in heat dissipation. The better the air circulation, the more effective the heat dissipation is. However, when the fan is installed in a system, due to the obstruction of the system housing 6, members within the system (including those members from which heat is to be dissipated) and the casing 9 etc., the air inlet is narrowed, resulting in increased flow resistance and reduced quantity of the air flow, thus deteriorating its performance of heat dissipation. Moreover, such a prior art fan inevitably creates, during rotation, a vortex flow in the vicinity of the narrow gap between the impeller tip T and the casing 9 (see FIG. 1B), resulting in an unpleasant noise.

FIG. 2 shows the flow field of a prior art suction fan installed outside the system. In this figure, the fan sucks the air current on the right side to the left side of the system so as to facilitate heat dissipation of the inner members 10, also acting as obstructions in the flow field, within the system. The disadvantage of this prior art suction fan resides in that, due to the existence of frame 3, the source of air sucked into and through the fan is restricted to only the axial air current flowing from the right to the left.

Similarly, FIG. 3 shows the flow field of a prior art suction fan installed within the system. The way of installing this prior art suction fan resembles the aforementioned prior art suction fan installed outside the system as shown in FIG. 2. Its disadvantage resides in that, due to the existence of frame 3, the flow field exit of the air current blown out from the fan is restricted to only the portion free from being hindered by the members 10 within the system, acting as obstructions in the flow field.

Similarly, FIG. 4 shows the flow field of a blowing fan installed within the system, and FIG. 5 shows the flow field of a blowing fan installed outside the system. On analyzing the flow field of FIG. 4, it is noticed that the disadvantage of the fan within the system is that the source of air sucked into and through the fan is restricted to only the axial air current flowing from the right to the left. Moreover, on analyzing the flow field shown in FIG. 5, it is seen that the disadvantage of the fan within the system is that the air current blown out from the fan is limited to only the axial air current flowing from the right to the left.

Summing up the above analysis with respect to the flow fields of FIGS. 2 to 5, it is noticed that the disadvantage of each of the prior art fans is that the air flow rate through each fan is reduced due to reduced area of its air entrance or air exit subject to the influence of frame 3.

An object of this invention is to enlarge the air entrance and the air exit of a fan so as to increase the air flow rate of the fan, thereby facilitating the heat dissipation efficiency of the fan.

Besides, as shown in FIG. 1B, since the motor mounting seat 4 is connected to motor 1 on the one hand and also directly fixed to the system housing 6 on the other hand, it cannot efficiently absorb or reduce the vibration produced during operation of the motor. Thus, vibration produced by the motor 1 is directly transmitted to the system housing 6 through the motor casing 4, resulting in an annoying noise level. This is also a problem that this invention wishes to solve.

SUMMARY OF THE INVENTION

In order to solve the aforementioned problem, this invention provides an improved construction of a fan which enlarges the air entrance or the air exit, increases the air flow rate, and reduces the noise produced.

According to this invention, an improved construction of a fan fixed to a system housing when in use, includes: an impeller which rotates and cuts the surrounding fluid enabling the surrounding fluid to form an axial flow, and which extends over a length in the axial direction of the fan; a driving device having a stator and a rotor adapted to drive the impeller to rotate; and a casing including a mounting seat fastened to the system housing for mounting the stator onto the system housing, and a frame adapted to cover outside the outer circumference of the impeller; characterized in that the frame of the casing covers only part of the length in the axial direction outside the outer circumference of the impeller.

In the above improved construction of a fan, the frame and the mounting seat may be independent members which are fastened together.

In the above improved construction of a fan, the mounting seat is preferably formed by vibration absorptive material at least at one of the portion where the mounting seat is fastened to the system housing and the portion where the mounting seat is fastened to the frame.

In the above improved construction of a fan, preferably at least one washer is sandwiched between the system housing and the mounting seat so as to isolate the system housing from the mounting seat, thereby preventing the vibration produced by the fan from being transmitted to the system housing.

In the improved construction of a fan according to this invention, the mounting seat and the frame may also be integrally formed.

In the above improved construction of a fan, the mounting seat is preferably formed by vibration absorptive material at the portion where the mounting seat is fastened to the system housing.

In the above improved construction of a fan, preferably at least one washer is sandwiched between the system housing and the mounting seat so as to isolate the system housing from the mounting seat, thereby preventing the vibration produced by the fan from being transmitted to the system housing.

By adopting the above improved construction of a fan according to this invention, the air entrance or the air exit of the fan is enlarged, thus increasing the air flow rate produced in the system. Also, the air resistance is reduced, thus restraining the impeller tip from creating vortex flow and noise. Besides, provision of a mounting seat partially formed by vibration absorptive material at least near the location where the mounting seat is fastened to the system housing or to the frame of the fan (hereunder referred to as "the absorptive fastening portion") and also washer(s) sandwiched between the system housing and the mounting seat greatly reduces vibration of the fan.

DETAILED DESCRIPTION OF PREFERRED EMBODIMENTS

Figure 6A:
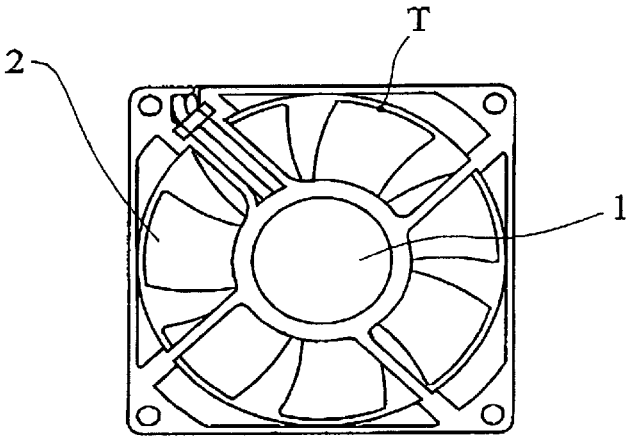
FIG. 6A is a front view of an improved fan according to this invention.
Figure 6B:
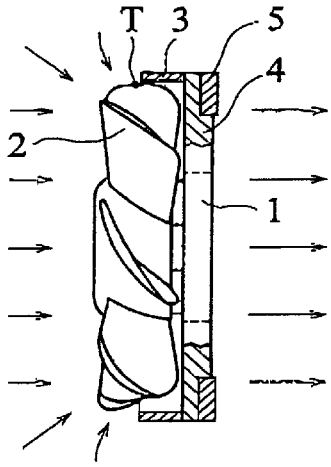
FIG. 6B is a sectional side view of the same fan.
Figure 7:
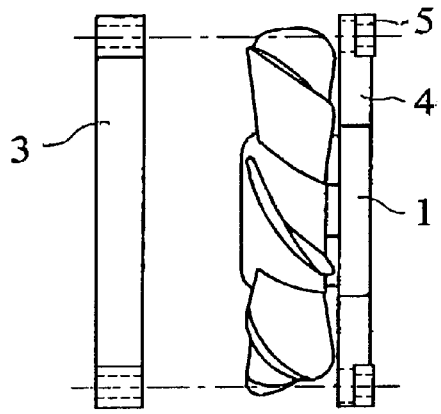
FIG. 7 is an exploded side view of the same fan.
Figure 8A:
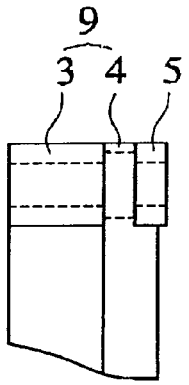
FIG. 8A is a partially enlarged side view showing the structure near the absorptive fastening portion of the fan (in an assembled state) shown in FIG. 7.
Figure 8B:
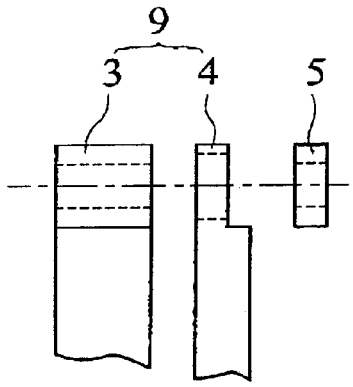
FIG. 8B is an exploded side view showing the structure near the absorptive fastening portion of the fan shown in 8A.
Figure 9:
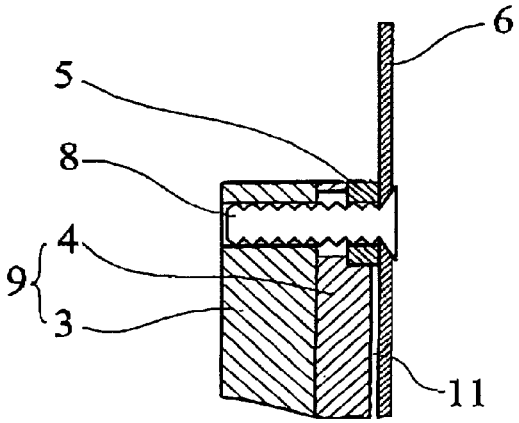
FIG. 9 is a partially enlarged sectional view showing the situation wherein an improved fan of this invention as illustrated in FIGS. 7, 8A and 8B is assembled in the system housing, particularly showing the vicinity of the absorptive fastening portion.

FIG. 6A is a front view of an improved fan according to this invention. FIG. 6B is a sectional side view of the same fan. The arrows shown in FIG. 6B represent the flow field produced by the fan. FIG. 7 is an exploded side view of the same fan. FIG. 8A is a partially enlarged side view showing the structure near the absorptive fastening portion of the fan (in an assembled state) shown in FIG. 7. FIG. 8B is an exploded side view showing the structure near the absorptive fastening portion of the fan shown in 8A. FIG. 9 is a partially enlarged sectional view showing the situation wherein an improved fan of this invention as illustrated in FIGS. 7, 8A and 8B is assembled in the system housing, particularly showing the vicinity of the absorptive fastening portion.

As illustrated in FIGS. 6A through 9, an improved fan according to this invention mainly includes a motor 1, an impeller 2, and a casing 9. The impeller 2 rotates and cuts the surrounding fluid enabling the surrounding fluid to form an axial flow, and extends over a length in the axial direction of the fan. The motor 1 is provided for rotating the impeller 2 and includes a stator (not shown in the Figs.) and a rotor (not shown in the Figs.) adapted to rotate the impeller 2. The casing 9 includes a mounting seat 4 fastened to a system housing 6 when in use for mounting the motor 1 and a frame 3 adapted to cover outside the outer circumference of the impeller 2.

Figure 1A:
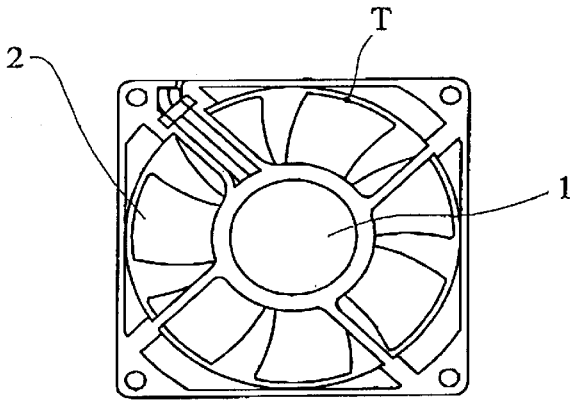
FIG. 1A is a front view of a prior art fan.
Figure 1B:
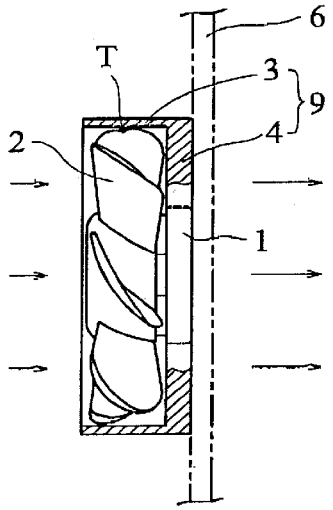
FIG. 1B is a sectional side view of the same prior art fan.

As can be readily found by comparing FIG. 6B with FIG. 1B, the main difference between the fan of this invention and the prior art fan (FIG. 1B) resides in that the frame 3 in the former fan covers only part of the length in the axial direction outside the outer circumference of the impeller 2 (see FIG. 6B), rather than the full length in the axial direction outside the outer circumference of the impeller 2 as in the case of the latter fan (see FIG. 1B).

After comparing the flow field of FIG. 6B with that of FIG. 1B, it is found that, besides the air current sucked from the front side of the impeller 2 (namely, the left side of the impeller 2) which is the same as that of the above-described prior art fan, an extra amount of air current is sucked from the side portion of the impeller, thereby increasing the air flow rate blown out. This is because that the frame 3 covers only part of the length in the axial direction outside the outer circumference of the impeller 2, thus enlarging the air entrance and reducing the air resistance so as to increase the air flow rate of the fan.

As shown in FIG. 7 and FIG. 9, motor 1 is mounted on the mounting seat 4 which, in turn, is fastened to the system housing 6 by a screw 8 with a washer 5 being sandwiched therebetween so as to isolate the system housing 6 from the mounting seat 4, thereby preventing the vibration produced by the fan from being transmitted directly to the system housing 6.

In the embodiment shown in FIGS. 8A, 8B and 9, the mounting seat 4 is formed by vibration absorptive material at least at one of the portion where the mounting seat 4 is fastened to the system housing 6 and the portion where the mounting seat 4 is fastened to the frame 3. Thus, due to these absorptive fastening portions, vibration produced by the fan or its motor may be further absorbed or reduced.

Consequently, by adopting the above-described improved fan according to this invention, vibration produced by the fan or its motor is not only greatly absorbed by the absorptive fastening portions, but also further isolated by the washer 5 sandwiched between the motor casing 4 and the system housing 6, thus little vibration may be transmitted to the system housing 6.

Moreover, characteristics of flow fields in several cases are analyzed and some performance of a fan according to this invention and that of a prior art fan are compared.

Figure 2:
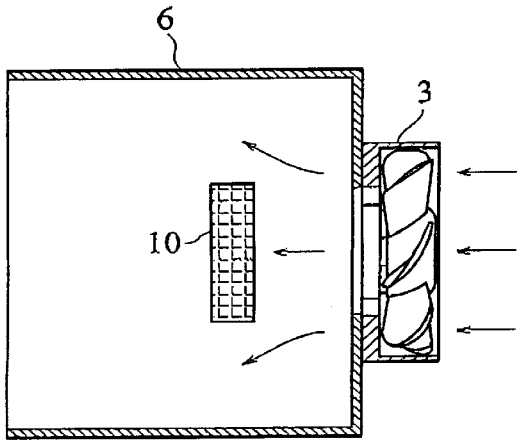
FIG. 2 shows the flow field of a prior art suction fan installed outside the system.
Figure 3:
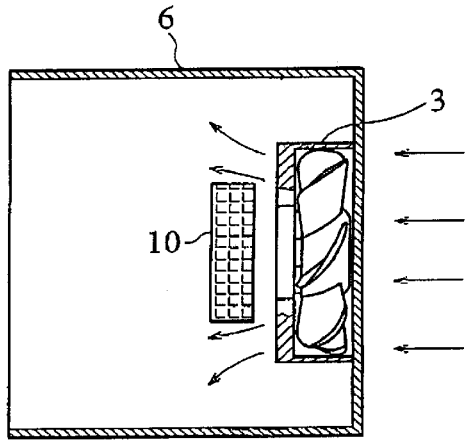
FIG. 3 shows the flow field of a prior art suction fan installed within the system.
Figure 4:
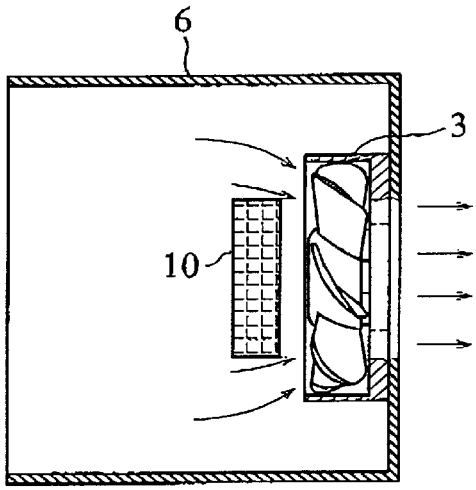
FIG. 4 shows the flow field of a blowing fan installed within the system.
Figure 5:
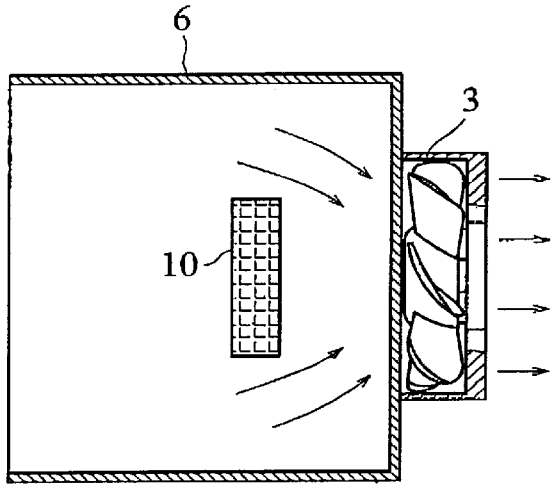
FIG. 5 shows the flow field of a blowing fan installed outside the system.
Figure 10:
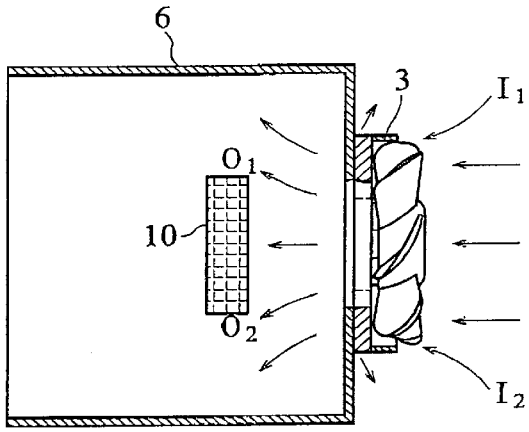
FIG. 10 shows the flow field of an improved suction fan of this invention installed outside a system.

FIG. 10 shows the flow field of an improved suction fan of this invention installed outside a system. Comparing FIG. 10 and FIG. 2, we can find the difference between the flow fields of the fan of this invention and a prior art fan when installed in a similar manner in the same system. According to this invention, as the frame 3 of casing 9 covers only part of the length in the axial direction outside the outer circumference of the impeller 2, an extra amount of intake air $I_1$, $I_2$ is sucked into the fan through the portion uncovered by frame 3 and thus a corresponding amount of air $O_1$ and $O_2$ is blown out into the system, as compared with the situation of a prior art fan (FIG. 2). This increases the available air flow rate and improves the efficiency of heat dissipation of the system.

Figure 11:
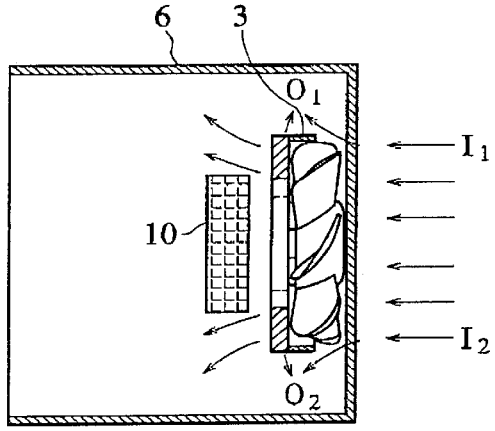
FIG. 11 shows the flow field of an improved suction fan of this invention installed within a system.
Figure 12:
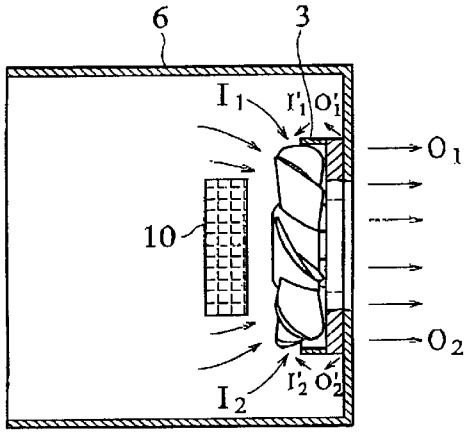
FIG. 12 shows the flow field of an improved blowing fan of this invention installed within a system.

Similarly, FIG. 11 shows the flow field of an improved suction fan of this invention installed within a system, FIG.

Figure 13:
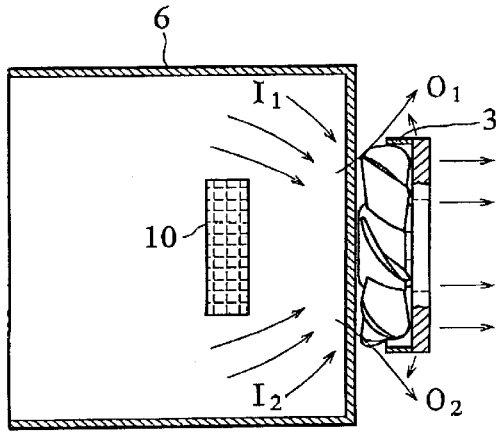
FIG. 13 shows the flow field of an improved blowing fan of this invention installed outside a system.

12 shows the flow field of an improved blowing fan of this invention installed within a system, and FIG. 13 shows the flow field of an improved blowing fan of this invention installed outside a system. Summing up a comparison between the flow fields of FIGS. 11 and 3, FIGS. 12 and 4, and FIGS. 13 and 5, it is noticed that the result is similar to the case of comparison between the flow fields of FIGS. 10 and 2. Namely, an extra amount of intake air $I_1$, $I_2$ is sucked into the fan through the portion uncovered by frame 3 and thus a corresponding amount of air $O_1$ and $O_2$ is blown out into the system, when the fan of this invention is compared with a prior art fan installed in a similar manner in the same system. This increases the available air flow rate and improves the efficiency of heat dissipation of the system.

Besides increasing the air flow rate, the improved fan of this invention also reduces the vortex flow produced by the impeller tip and the air resistance of the frame, thereby diminishing the noise as the frame covers only part of the length in the axial direction outside the outer circumference of the impeller.

Moreover, as can be easily seen from FIG. 9, one or more than one small gap 11 is formed between the system housing 6 and the mounting seat 4 with the washer 5 inserted therebetween. Referring again to FIG. 12, the gap 11 is helpful in supplying side airflow $O_1'$ and $O_2'$ out of the fan and is also helpful in inputting side airflow $I_1'$ and $I_2'$ into the fan, thereby obtaining circulative airflow by the airflow $O_1'$ and $I_1'$, or $O_2'$ and $I_2'$ to improve the heat dissipation effect for some elements around the frame 3.

While a preferred embodiment of this invention has been described using specific terms, such description is for illustrative purpose only. For example, though the mounting seat 4 and the frame 3 are illustrated to be independent members which are fastened together, they may optionally be integrally formed. Consequently, it is to be understood that changes and variations may be made without departing from the spirit or scope of the following claims.

What is claimed is:

1. An improved construction of a fan fixed to a system housing when in use, comprising:

a mounting seat fastened to said system housing with at least one washer inserted therebetween;

a frame fastened on and around said mounting seat;

a driving device mounted on said mounting seat; and an impeller driven by said driving device, wherein at least one gap is formed between said mounting seat and said frame, and said impeller is partially covered by said frame to provide for a side flow of air to the fan.

2. The construction of the fan according to claim 1, wherein said mounting seat and said frame are integrally formed.

3. The fan according to claim 1, wherein the frame extends from the mounting seat for only a limited axial extent so as to cover approximately one-half the thickness of the impeller blades, said approximately one-half the thickness being that axial portion of the impeller blade located closest to the mounting seat.

* * * * *